US005351343A

United States Patent [19]

Harbison

[11] Patent Number: 5,351,343

[45] Date of Patent: Oct. 4, 1994

[54] EAR FLAP HAT

[76] Inventor: Brian P. Harbison, 2855 Polk St., #304, San Francisco, Calif. 94123

[21] Appl. No.: 983,362

[22] Filed: Nov. 30, 1992

[51] Int. Cl.[5] ..... A42B 1/06

[52] U.S. Cl. ..... 2/423; 2/172; 2/195.1; 2/209

[58] Field of Search ..... 2/172, 185 R, 199, 204, 2/209, 423, 189, 195, 196, 202, 209.1

[56] References Cited

U.S. PATENT DOCUMENTS

| | | | |
|---|---|---|---|
| D. 60,272 | 1/1922 | Slotoroff | 2/172 |
| D. 121,457 | 7/1940 | Dell | 2/204 |
| 811,178 | 1/1906 | Saks . | |
| 1,531,394 | 3/1925 | Hart . | |
| 2,199,427 | 5/1940 | Dohen | 2/198 |
| 2,417,986 | 3/1947 | Marder et al. | 2/198 |
| 2,470,833 | 5/1949 | Moore | 34/95 |
| 2,557,552 | 6/1951 | Martin | 2/198 |
| 2,561,857 | 7/1951 | Goldman | 2/185 R |
| 2,970,318 | 2/1961 | Nordling | 2/203 |
| 2,988,748 | 6/1961 | Rollins-Dudley | 2/202 |
| 3,384,904 | 5/1968 | Hofmann | 2/198 |
| 3,512,181 | 5/1970 | Osborne | 2/195 |
| 3,518,701 | 7/1970 | Fekete | 2/172 |
| 3,555,565 | 1/1971 | Zimmon et al. | 2/198 |
| 4,462,117 | 7/1984 | Brunelle | 2/202 |
| 4,551,859 | 11/1985 | Gerhardt | 2/172 |
| 4,599,749 | 7/1986 | Childs et al. | 2/199 |
| 4,633,530 | 1/1987 | Satterfield | 2/209 |
| 4,662,007 | 5/1987 | Lipkin | 2/195 |
| 4,683,596 | 8/1987 | Cole | 2/174 |
| 4,845,782 | 7/1989 | Gregg | 2/172 |
| 4,937,885 | 7/1990 | Gregg | 2/196 |
| 4,991,236 | 2/1991 | Pritchett | 2/189 |
| 5,046,193 | 9/1991 | Foresman | 2/423 |
| 5,144,695 | 9/1992 | Schweizer | 2/189 |

FOREIGN PATENT DOCUMENTS

| | | | |
|---|---|---|---|
| 1172804 | 8/1984 | Canada | 2/195 |

*Primary Examiner*—Clifford D. Crowder
*Assistant Examiner*—Diana L. Biefeld
*Attorney, Agent, or Firm*—Haverstock, Medlen & Carroll

[57] ABSTRACT

The present invention is an ear flap hat that is designed to be worn in both good and bad weather. The hat gives the wearer the flexibility of wearing the hat with the ear flaps down covering the wearer's ears or positioning the ear flaps in an up position on the crown of the wearer's head so that the wearer's ears are exposed. A cord and cord lock are also included with this hat so that the wearer can tighten the cap down and affix it to their head when the ear flaps are down. The cord can also be used to hold the ear flaps in the up position when they are not covering the wearer's ears. When the ear flaps are in the down position, covering the wearer's ears, the cord can be positioned in the back of the wearer's neck or under the wearer's chin depending on the desired tightness and the weather conditions. The hat will be less likely to fly off during gusts of high wind when the cord is positioned under the wearer's chin.

7 Claims, 2 Drawing Sheets

EAR FLAP HAT

FIELD OF THE INVENTION

This invention relates to hats, specifically hats designed for use in varying weather conditions, which have multi-positionable ear flaps that can be affixed to the wearer's head.

BACKGROUND OF THE INVENTION

The present invention and these types of hats in general are designed for protecting the wearer's head and ears from the elements in extremely cold weather and further providing a functional hat that is comfortable to wear during non-extreme weather. Hats of this type have been known generally with ear flaps or with a single piece of material that is designed to wrap around the wearer's head and cover both ears at the same time. Such hats typically include a device that will hold the hat to the wearer's head in certain weather conditions, such as wind. This fixation usually takes the form of a strap that is designed to be secured under the wearer's chin so that it will keep the hat in place on the wearer's head. The problem with this type of chin-strap is that it can be uncomfortable and may cause irritation of the wearer's neck.

An early hat of this type was presented by Estella P. Marder and William N. Green in U.S. Pat. No. 2,417,986. This hat consisted of a crown and a flap made up of fabric that is stitched to the crown which is designed to cover the back of the wearer's head and neck as well as the wearer's ears to fully enclose the wearer's hair. This flap cannot be folded up and worn in an up position. This hat has one functional position in which it can be worn and that is with the flap down and covering the crown, the back and the ears of the wearer's head. This cap does have the advantage of tightening to the wearer's head in the back instead of under the wearer's chin, but the wearer does not have the ability to tighten this cap under their chin if they so desire.

Another hat of this type was presented by Ron Gregg in U.S. Pat. No. 4,845,782. This hat consisted of a crown, a neck flap connected to two ear flaps, and a visor. The neck flap and ear flaps are all contained in one piece of material that is connected to the crown of the hat and can be folded up and fastened to the crown of the hat to be worn in the up position during good weather. The ear flaps are connected to the crown of the hat using hook and pile fasteners attached to both the crown and each ear flap. The hat also includes a drawstring which can be used to gather the neck flap and ear flaps into a snug engagement with the wearer's neck. The hat as presented also includes a separate removable chinstrap which can be affixed to the earflaps of the hat to hold it tightly to the wearer's head during inclimate weather and wind. This hat requires three separate and distinct securing devices in order for the wearer to have the flexibility to wear the hat in all weather conditions: a drawstring is used to tighten the hat to the back of the wearer's neck, a detachable chinstrap is used to tighten the hat under the wearer's chin to hold the hat on during wind, and hook and pile fasteners are used to hold the ear flaps and neck flap in an up position.

What is needed is a hat that is suitable to be worn in all types of weather conditions, but that does not require numerous devices and attachments in order to achieve this versatility. Further, a hat of this type is needed which includes ear flaps that can be positioned either up or down and can be tightened in either position by a single device.

SUMMARY OF THE INVENTION

The present invention is an ear flap hat that is designed to be worn in both good and bad weather. The hat gives the wearer the flexibility of wearing the hat with the ear flaps down covering the wearer's ears or positioning the ear flaps in an up position on the crown of the wearer's head so that the wearer's ears are exposed. A cord and cord lock are also included with this hat so that the wearer can tighten the cap down and affix it to their head when the ear flaps are down. The cord can also be used to hold the ear flaps in the up position when they are not covering the wearer's ears. When the ear flaps are in the down position, covering the wearer's ears, the cord can be positioned in the back of the wearer's neck or under the wearer's chin depending on the desired tightness and the weather conditions. The hat will be less likely to fly off during gusts of high wind when the cord is positioned under the wearer's chin.

DETAILED DESCRIPTION OF THE PRESENT INVENTION

Figure 1:
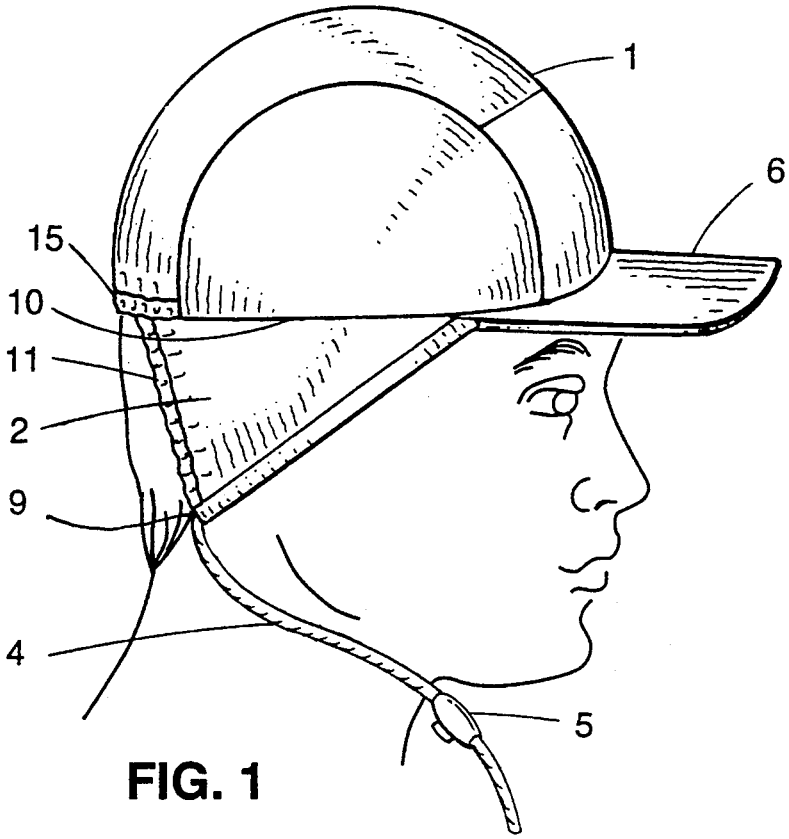
FIG. 1 is a side view of the ear flap hat with the cord positioned under the wearer's chin.

The Ear Flap Hat is designed to be worn in all weather conditions. As shown in FIG. 1, the hat includes a crown 1, earflaps 2, a cord 4, a cord lock 5, and a visor 6. The ear flaps are connected to the bottom portion of the crown 15, along the first edge 10, on opposite sides of the hat. The second edge of each ear flap 11 is made up of an elastic band to allow the ear flaps to fit comfortably over the wearer's ears. In the preferred embodiment the cord is attached to each side of the hat through enclosures 9 that are connected to the third edge of each ear flap 9. The enclosures run from the crown, along the outer edge of each ear flap, down to the bottom corner of each ear flap. In an alternate embodiment, as illustrated in FIG. 3, the cord can be attached to the bottom corner of each ear flap. preferred visor is shown in FIG. 1, but the visor can be made in different sizes or the hat can be made without a visor.

Figure 2:
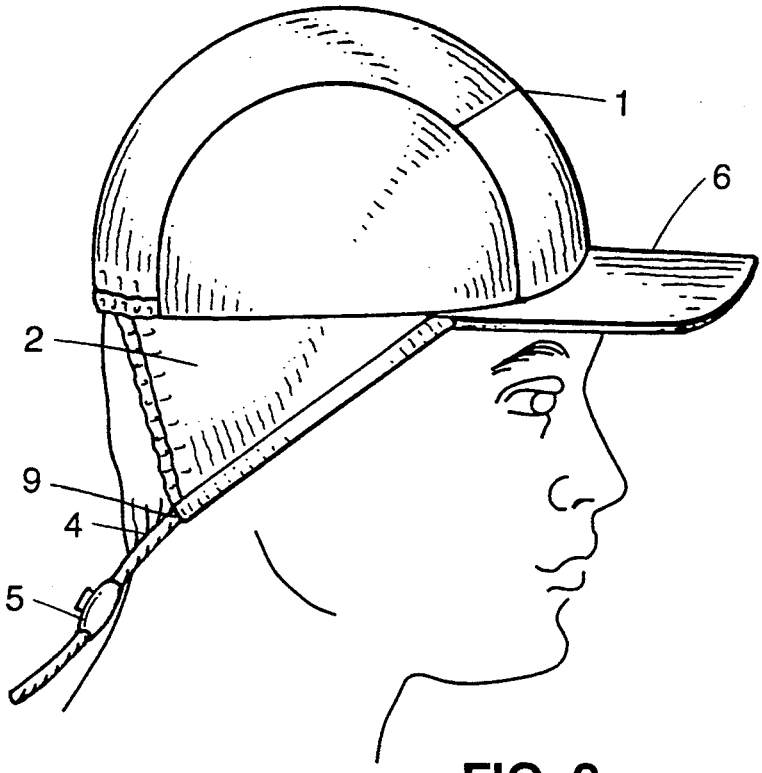
FIG. 2 is a side view of the ear flap hat with the cord positioned at the back of the wearer's neck.

During cold weather conditions the ear flaps 2 can be positioned down as shown in FIG. 1. During extremely cold weather conditions or wind, the cord 4 and the cord lock 5 can be positioned under the wearer's chin to hold the cap snugly onto the wearer's head. Alternatively, the cord and cord lock can be positioned behind the wearer's neck as shown in FIG. 2. To tighten the hat onto the wearer's head, the cord is pulled and the cord lock, with bead depressed, is slid along the cord towards the wearer until the desired tightness is achieved.

Figure 3:
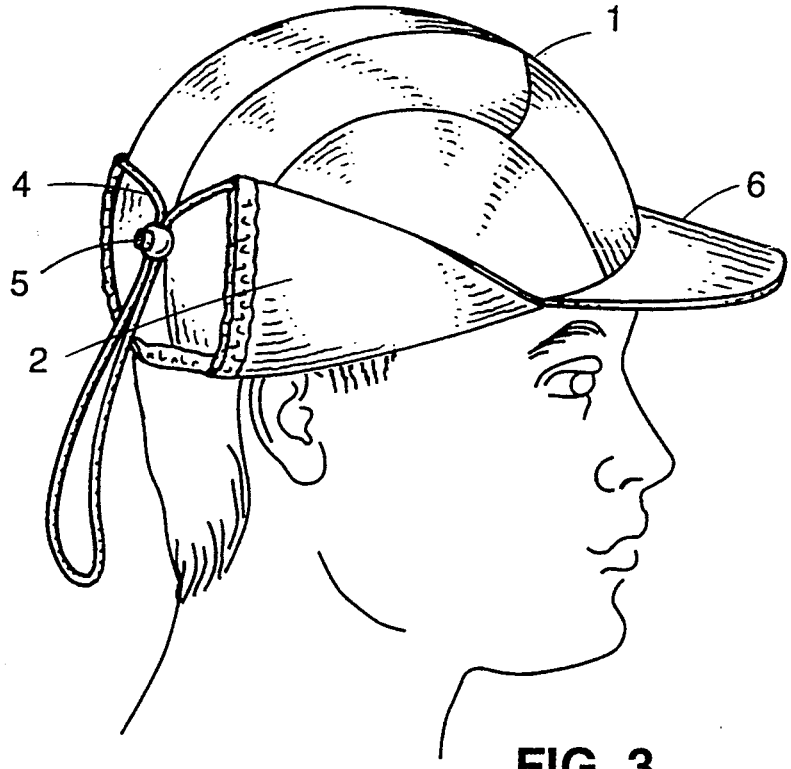
FIG. 3 is a perspective view of the ear flap hat with the ear flaps secured by the cord and cord lock in the up position.

During warmer weather conditions, or when the wearer does not want the constraints of the ear flaps 2, the ear flaps can be positioned up alongside the crown as shown in FIG. 3. The ear flaps can be tightened in this position in the same manner that they are tightened when they are in the down position, using the cord 4 and the cord lock 5.

The crown 1 of the hat can be made up of numerous panels coupled together. The preferred embodiment of the crown includes five panels stitched together, but the crown could alternatively be made up of any number of panels stitched together.

Figure 4:
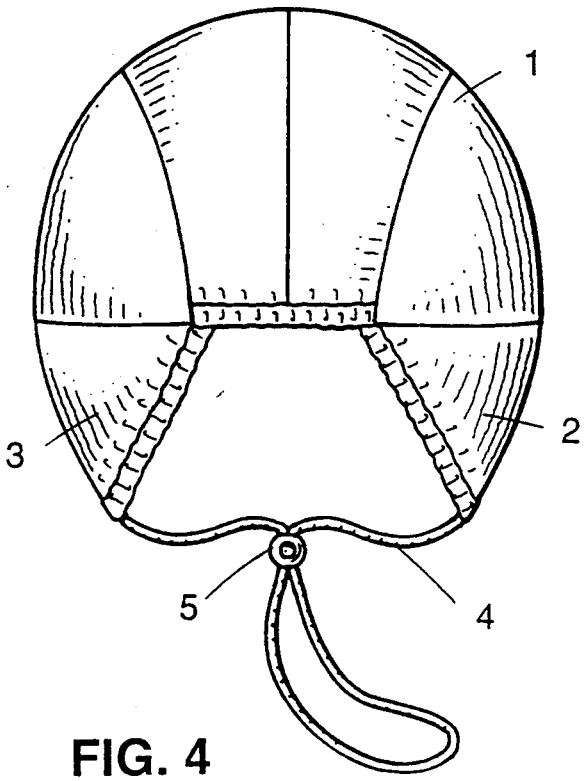
FIG. 4 is a rear view of the ear flap hat with the ear flaps down.
Figure 5:
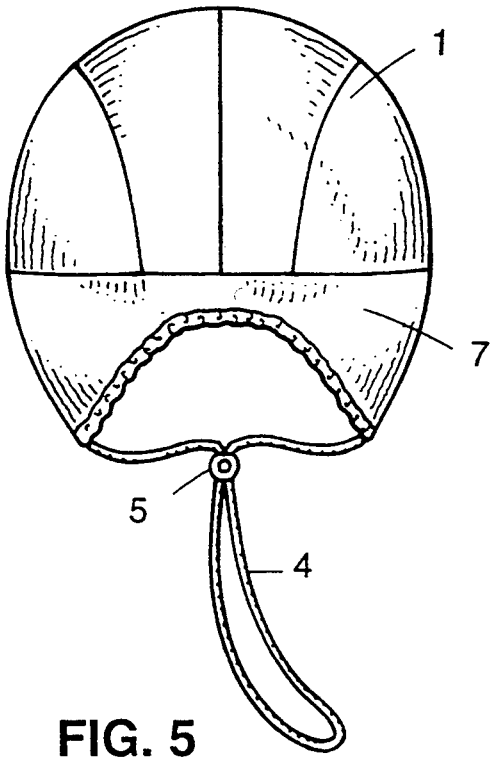
FIG. 5 is a rear view of the ear flap hat with an alternate rear closure which includes a neck flap.

FIG. 4 shows a rear view of the hat with separate right and left ear flaps, 2 and 3. The preferred embodiment of the hat contains two separate ear flaps. The hat can also be made with one piece of material that serves as both ear flaps and also covers the neck of the wearer as shown in FIG. 5. This lower flap 7 modifies the rear closure of the hat extending the covering down over the wearer's neck in order to provide additional protection from the elements. This lower flap can also be positioned up alongside the crown during warmer weather conditions. When this lower flap is in the down position it can be tightened using the cord and the cord lock in the same manner that the separate ear flaps are tightened to the wearer's head, either behind the neck or under the chin.

I claim:

1. An ear flap hat comprising:

a. a crown, said crown having a top portion and a bottom portion;

b. a first triangular-shaped ear flap, said first ear flap having a first edge connected to the bottom portion of the crown and positioned to cover one of a wearer's ears, a second edge positioned toward the rear of the wearer's head, and a third edge having a tubular channel sewn therein;

c. a second triangular-shaped ear flap, said second ear flap having a first edge connected to the bottom portion of the crown on the opposing side from the first ear flap positioned to cover the remaining ear of the wearer, a second edge positioned toward the rear of the wearer's head, and a third edge having a tubular channel sewn therein;

d. a first cord positioned within the channel of the first ear flap and coupled to the bottom portion of the crown at the junction of the first edge and the third edge of the first ear flap;

e. a second cord positioned within the channel of the second ear flap and coupled to the bottom portion of the crown at the junction of the first edge and the third edge of the second ear flap;

f. a cord lock, said cord lock slidably connected to both the first cord and the second cord for adjustably securing the ear flap hat on a wearer's head; and g. a visor connected to the crown and the first and second ear flaps for shielding the wearer's face from above.

2. The ear flap hat according to claim 1 further comprising a strechable elastic means for form fitting the hat to the wearer's head coupled to both of the second edges and a portion of the bottom portion of the crown.

3. The ear flap hat according to claim 2 wherein the first cord and the second cord are formed of a continuous loop.

4. The ear flap hat as claimed in claim 2 wherein both the first and second ear flaps contain a lining for protecting the wearer's ears from the elements.

5. An ear flap hat comprising:

a. a crown, said crown having a top portion and a bottom portion;

b. a first three-sided ear flap, said first ear flap having a first edge coupled to the bottom portion of the crown and positioned to cover one of a wearer's ears, a second edge positioned toward the rear of the wearer's head, and a third edge, the junction of the second edge and the third edge forming a bottom corner of the first ear flap;

c. a second three sided ear flap, said second ear flap having a first edge coupled to the bottom portion of the crown on the opposing side from the first ear flap positioned to cover the remaining ear of the wearer, a second edge positioned toward the rear of the wearer's head, and a third edge, the junction of the second edge and the third edge forming a bottom corner of the second ear flap, wherein the first edge of the second ear flap is spaced apart and positioned a predetermined distance away from the first edge of the first ear flap;

d. a first cord coupled to the bottom corner of the first ear flap;

e. a second cord coupled to the bottom corner of the second ear flap;

f. a cord lock, said cord lock slidably coupled to both the first cord and the second cord for adjustably securing the ear flap hat on the wearer's head;

g. a visor coupled to the crown for shielding the wearer's face from above; and h. a stretchable elastic means for form fitting the hat to the wearer's head coupled to both of the second edges and a portion of the bottom portion of the crown.

6. The ear flap hat according to claim 5 wherein the first cord and the second cord are formed of a continuous loop.

7. The ear flap hat according to claim 6 wherein both the first and second ear flaps contain a lining for protecting the wearer's ears from the elements.

* * * * *